US011608590B2

(12) United States Patent
Bahl et al.

(10) Patent No.: US 11,608,590 B2
(45) Date of Patent: Mar. 21, 2023

(54) FIBER FORMING COMPOSITIONS, FIBERS AND METHODS FOR PRODUCTION

(71) Applicant: TEKNOR APEX COMPANY, Pawtucket, RI (US)

(72) Inventors: Kushal Bahl, Providence, RI (US); Darnell C. Worley, II, Uxbridge, MA (US); Chris LaTulippe, Fitchburg, MA (US)

(73) Assignee: TEKNOR APEX COMPANY, Pawtucket, RI (US)

( * ) Notice: Subject to any disclaimer, the term of this patent is extended or adjusted under 35 U.S.C. 154(b) by 154 days.

(21) Appl. No.: 15/435,810

(22) Filed: Feb. 17, 2017

(65) Prior Publication Data

US 2017/0241072 A1 Aug. 24, 2017

Related U.S. Application Data

(60) Provisional application No. 62/297,323, filed on Feb. 19, 2016.

(51) Int. Cl.
*D01F 6/42* (2006.01)
*D06M 15/256* (2006.01)
(Continued)

(52) U.S. Cl.
CPC ..... *D06M 15/256* (2013.01); *D01F 1/10* (2013.01); *D01F 6/42* (2013.01); *D01F 6/56* (2013.01);
(Continued)

(58) Field of Classification Search
CPC .. D01D 5/253; D01F 1/10; D01F 6/42; D01F 6/56; D02G 3/00; D06M 15/256;
(Continued)

(56) References Cited

U.S. PATENT DOCUMENTS 6,403,710 B1 6/2002 Ahmed et al.
6,777,082 B2 8/2004 Patel et al.
(Continued)

FOREIGN PATENT DOCUMENTS

JP 2006045291 A 2/2006
WO 2012091792 A1 7/2012

OTHER PUBLICATIONS

Hassan, Advances in Spun-blown Fiber Technology and Its Technical Applications, Biax-Fiberfilm Corporation, NETInc Conference (Year: 2015).*
(Continued)

*Primary Examiner* — Holly Rickman
*Assistant Examiner* — Linda N Chau
(74) *Attorney, Agent, or Firm* — Hudak, Shunk & Farine Co. LPA

(57) ABSTRACT

Compositions especially suitable for forming fibers and films having good elasticity and relatively high modulus are disclosed. Surprisingly, compositions including a styrenic block copolymer having a relatively high melt flow rate, and a detackifier, and optionally, but preferably in some embodiments a polyolefin (co)polymer, and/or polystyrene polymer, and/or a softener have good draw down performance and are processable into fibers having low tack, relatively high modulus and tensile strength. The fibers produced from the composition can be processed easily and are useful to manufacture articles such as fabrics, both woven and non-woven, webs, threads, and yarns. In various embodiments, unique fiber structures are produced having low tack and desirable elasticity.

12 Claims, 3 Drawing Sheets

(51) Int. Cl.

| | |
|---|---|
| ***D01F 1/10*** | (2006.01) |
| ***D01F 6/56*** | (2006.01) |
| ***D02G 3/36*** | (2006.01) |
| ***D06M 15/643*** | (2006.01) |
| *D01D 5/253* | (2006.01) |
| *D06M 15/59* | (2006.01) |
| *D06M 15/507* | (2006.01) |
| *D06M 101/20* | (2006.01) |

(52) U.S. Cl.
CPC ..... *D02G 3/36* (2013.01); *D06M 15/643* (2013.01); *D01D 5/253* (2013.01); *D06M 15/507* (2013.01); *D06M 15/59* (2013.01); *D06M 2101/20* (2013.01); *D06M 2200/40* (2013.01)

(58) Field of Classification Search
CPC .. D06M 15/507; D06M 15/59; D06M 15/643; D06M 2101/20; D06M 2200/40
See application file for complete search history.

(56) References Cited

U.S. PATENT DOCUMENTS

| | | | | |
|---|---|---|---|---|
| 7,309,522 | B2 | 12/2007 | Webb et al. | |
| 7,662,323 | B1 | 2/2010 | Flood et al. | |
| 2002/0099107 | A1 | 7/2002 | Tucker et al. | |
| 2005/0101739 | A1 | 5/2005 | Webb et al. | |
| 2005/0196612 | A1 | 9/2005 | Flood et al. | |
| 2005/0197464 | A1 | 9/2005 | Handlin, Jr. et al. | |
| 2007/0055015 | A1 | 3/2007 | Flood et al. | |
| 2007/0173162 | A1 | 7/2007 | Ethiopia et al. | |
| 2009/0156727 | A1* | 6/2009 | Bensason | D01F 1/10 524/423 |
| 2011/0253152 | A1* | 10/2011 | Lin | D04H 1/4291 128/849 |
| 2013/0225020 | A1 | 8/2013 | Flood et al. | |
| 2014/0371377 | A1 | 12/2014 | Salazar | |

OTHER PUBLICATIONS

Yilgor et al., Polysiloxane Containing Copolymers: A Survey of Recent Developments, pp. 1-86 (Year: 1987).*

Handlin et al., "A New Styrenic Block Copolymer Designed for Polyolefin-Like Processing For Compounding, Films and Fibers", Article, 2015, pp. 1-5, TSRC, U.S., available online at http://tsrcdexco.com/uploads/pdfs/ANTEC 2015 Handlin Cheng Berard Paper 2097668.pdf.

International Search Report and Written Opinion dated May 5, 2017 for International Application PCT/US17/18338.

Extended European Search Report dated Aug. 23, 2019 for European Application 17753909.5.

* cited by examiner

FIBER FORMING COMPOSITIONS, FIBERS AND METHODS FOR PRODUCTION

FIELD OF THE INVENTION

The present invention relates to compositions especially suitable for forming fibers and films having good elasticity and relatively high modulus and tensile strength. Surprisingly, compositions including a styrenic block copolymer having a relatively high melt flow rate, and a detackifier, and optionally, but preferably in some embodiments a polyolefin (co)polymer and/or polystyrene polymer, and/or a softener have good draw down performance and are processable into fibers having high modulus, high tensile strength, and low tack. The fibers produced from the composition can be processed easily and are useful to manufacture articles such as fabrics, both woven and non-woven, webs, threads, and yarns. In various embodiments, unique fiber structures are produced having low tack and desirable elasticity.

BACKGROUND OF THE INVENTION

Many different types of polymers or polymeric materials, generally elastic or elastomeric, have been utilized to manufacturer fibers and films that can be formed into a wide variety of goods, such as but not limited to, wearable apparel, personal hygiene items and durable or disposable goods.

Various approaches are known in the art, see for example:

U.S. Pat. No. 6,403,710 relates to a two-component thermoplastic elastomeric composition comprising at least one block copolymer wherein the composition has essentially the same comparative elasticity, high temperature serviceability and hardness as the unmodified, undiluted (neat) block copolymer portion of the composition. The composition reportedly shows enhanced thermal stability and processability and is well suited for fabricating elastic moldings, films and fibers as well as for formulating with asphalts, adhesives and sealants. The elastomeric composition comprises (a) from about 50 to about 99 percent by weight of at least one block copolymer and (b) about 1 to about 50 percent by weight of at least one ethylene interpolymer having a density from about 0.855 g/cc to about 0.905 g/cc, wherein the ethylene interpolymer in the amount employed is a substantially inert extender of the block copolymer.

U.S. Pat. No. 6,777,082 relates to a fiber produced from a composition comprising at least one hydrogenated block copolymer and, optionally, at least one other polymer selected from the group consisting of a reactive tailored liquid polyurethane, an elastomeric or sulfonated ethylene/vinyl aromatic interpolymer, an elastomeric ethylene/$C_3$-$C_{20}$ $\alpha$-olefin interpolymer, an $C_3$-$C_{20}$ $\alpha$-olefin/conjugated diene interpolymer, an elastic polypropylene polymer, an enhanced polypropylene polymer, an elastomeric thermoplastic polyurethane, an elastic copolyester, a partially hydrogenated block copolymer, an elastic polyamide, a hydroxyl functionalized polyether (or polyetheramine), a styrene/conjugated diene interpolymer, and an elastomeric metallocene-catalyzed synthetic polymer or a blend or formulated system thereof.

U.S. Pat. No. 7,309,522 relates to compositions such as fibers, elastic yarns, wovens, nonwovens, knitted fabrics, fine nets, and articles produced at least in part from a styrenic block copolymer comprising at least two blocks produced from vinyl aromatic monomers and at least one block produced from alkyl-substituted, conjugated alkene monomers, where the block produced from the conjugated alkene may have sufficient substitution so as to prevent or significantly minimize thermal cross-linking of the residual unsaturation in the formed block during fiber formation. Additionally, the composition may be described as processable, without requiring any additives if, for example, the order-disorder-transition (ODT) temperature is less than about 280° C. The styrenic block copolymers are not hydrogenated.

U.S. Pat. No. 7,662,323 relates to bicomponent fibers having a sheath-core morphology where the sheath is a thermoplastic polymer and the core is an elastomeric compound are made which can be continuously extruded from the melt at high production rates. The elastomeric compound comprises a coupled, selectively hydrogenated block copolymer having high flow. The block copolymer has at least one polystyrene block of molecular weight from 5,000 to 7,000 and at least one polydiene block of molecular weight from 20,000 to 70,000 and having a high vinyl content of 60 mol % or greater. The bicomponent fibers are useful for the manufacture of articles such as woven fabrics, spunbond non-woven fabrics or filters, staple fibers, yarns and bonded, carded webs. The bicomponent fibers can be made using a process comprising coextrusion of the thermoplastic polymer and elastomeric compound.

U.S. Publication 2002/0099107 relates to a textile fiber including polypropylene blended with an impact modifier. The impact modifier can be less than 10% by weight of the composition. Examples of suitable impact modifiers include ethylene-propylene-diene-monomer (EPDM), styrene/ethylene-co-butadiene/styrene (SEBS), and styrene-poly(ethylene-propylene)-styrene-poly(ethylene-propylene) (SEPSEP). The textile fiber can be used to form a spunbond fiber, a staple fiber, a multi-fiber yarn, a knit fabric, a woven fabric, or a nonwoven fabric.

U.S. Publication 2007/0173162 relates to a nonwoven webs or fabrics. In particular, the present invention relates to nonwoven webs reportedly having superior abrasion resistance and excellent softness characteristics. The nonwoven materials comprise fibers made from of a polymer blend of isotactic polypropylene, reactor grade propylene based elastomers or plastomers, and optionally, a homogeneously branched ethylene/alpha olefin plastomer or elastomer. The publication also relates to cold drawn textured fibers comprising of a polymer blend of isotactic polypropylene and reactor grade propylene based elastomers or plastomers.

U.S. Publications 2013/02250220 and 2014/0371377 relate to applications for high melt flow, low viscosity, selectively hydrogenated styrene-butadiene-styrene (hSBS) or selectively hydrogenated controlled distribution styrene-butadiene/styrene-styrene (hSBSS) block copolymers, wherein the melt flow rate of said block copolymer is at least 100 g/10 min at 230° C. under 2.16 kg mass according to ASTM D1238. These block copolymers reportedly have the highest melt flow rate of any styrenic block copolymer also possessing high strength and elasticity. The publication encompasses various fields of use such as a fiberglass hSBS or hSBSS reinforced mat, low viscosity hSBS or hSBSS coatings for industrial uses, hot melt adhesives prepared from hSBS or hSBSS blended with polyalpha-olefins, and elastic film, fiber, and nonwoven constructions using hSBS or hSBSS.

WO 2012/091792 relates to elastic film formulations that reportedly have surprisingly high tensile strengths in addition to good viscosity stability and are based on a blend of two styrene block copolymers, namely, styrene-isoprene/butadiene-styrene and styrene-butadiene-styrene and a blend of two different styrene block copolymers that can be made by dry blending the block copolymer components. Then the blend can be extruded into uncross-linked film, fiber, or plurality of fibers.

Literature suggests that making articles requiring high draw down ratios such as monofilament or multifilament fibers via melt spinning was difficult or not possible using conventional hydrogenated styrenic block copolymers (HSBC) as a major component because of drawing and processing difficulties since conventional HSBCs are generally processed below their order disorder transition (ODT) temperature. This can restrict the achievable draw down ratio and also lead to problems such as melt fracture or ductile fracture. In order to improve draw down ratio, in one approach, a relatively high amount of plasticizers and additives are added as described in U.S. Pat. No. 7,309,522. This can lead to loss of mechanical properties and elasticity. HSBC fibers have been made before, but it has been possible by fully hydrogenating the SBC including the styrene phase, see U.S. Pat. No. 6,777,082. However, this can lead to much high level of tack and a much lower elasticity of the fiber due to absence of physical crosslinking of styrene.

Use of unsaturated SBC (USBC) for articles requiring high draw down ratios is widely reported in literature, see U.S. Pat. No. 6,403,710, elastic film fiber formulation. However SBS can easily degrade during melt spinning operation resulting in gel formation which is undesirable. These gels are considered to be defect sites in the fibers. Hence, although USBC fiber spinning is reported in literature either by blending with SIS or processing SBS above its ODT at close to 280° C., these USBCs are not as good as HSBCs in terms of thermal, oxidative stability and processability in general. For use in apparel, etc., the fibers are subjected to washing and drying cycles which require materials to have good thermal stability, durability and even weathering resistance. As a result, USBCs are not ideal for such applications. Also, USBCs with high flow rate which are suitable for melt spinning may have high di-block content which significantly reduces their elasticity as compared to HSBCs.

In view of the above approaches, there is still a need for compositions including styrenic block copolymers, that can be reliably and rapidly formed into fibers and films having low tack, good elasticity, relatively high modulus, relatively high tensile strength, as well as a desirable draw down performance.

SUMMARY OF THE INVENTION

Compositions are disclosed herein comprising at least one high melt flow rate styrenic block copolymer, a detackifier and optionally one or more i) polyolefin-based polymers such as an elastomer, plastomer or general homopolymer, and/or ii) a polystyrene, and/or iii) a softener wherein the compositions are especially suitable for preparing fibers and films.

Present invention relates to high flow HSBC compounds for melt spinning wherein the HSBCs are processed above their ODT temperature, i.e. temperature beyond which the styrene blocks are not phase separated, and hence can be drawn at very high ratios as they are in a homogenous melt phase. These high flow HSBCs have good tensile strength and elasticity and can be drawn by themselves. Polyolefin-based polymers and/or polystyrene are included in the compositions in some embodiments to modify the properties of the high flow styrenic block copolymers. In fact surprisingly, (draw down performance remain unaffected when polyolefin co(polymers) and/or polystyrene (co)polymers were used in conjunction with high flow styrenic block copolymers as compared to using the high flow styrenic block copolymers by itself. Materials like high flow polypropylene, polyolefins, polystyrene, plastomers, polyolefin elastomers etc. also help to achieve the high modulus desired in apparel constructions without sacrificing draw down performance of the compound.

Compositions of the present invention have good elasticity, high modulus, good draw down performance, good processing, thermal and weathering stability and are useful in articles such as fibers, films and the like.

The problems solved by high flow styrenic block copolymer based fiber technology in offering elasticity via multifunctional materials in a single fiber or yarn comprising one or more fibers with single or multi-filaments is achieved in reducing tack while maintaining elasticity. The contributions of macro scale materials when combined with hard-soft components are evident; yet, on the micro scale the soft-soft, elastic-elastic combination yielding performance attributes in reduction of tackiness associated with styrenic block copolymer technology is found herein.

In one aspect, an embodiment of a fiber monofilament structure is disclosed having various lobe structures resulting in irregular cross-sectional geometries that are symmetric or skewed from the central axis of the fiber. The irregular structure comprises a high flow styrenic block copolymer wherein the composition comprising the styrenic block copolymer contains either/or/and di-blocks, tri-blocks or radial structures. These compositional elements limit the degree of tackiness without destroying elasticity or processability.

In another aspect, an embodiment of a fiber is disclosed comprising multiple elastomeric materials in direct contact in a single strand, forming a monofilament fiber; that is elastic material comprising a high flow styrenic block copolymer wherein the sub fiber component retains a high degree of elasticity and tack; while a second polymer component imparts a buffer zone in addition to remaining part of the sub fiber structure. The complete structure offers high elasticity and low tack.

In another aspect, a fiber is composed of multiple strands or filaments in which the monofilament comprising a high flow styrenic block copolymer is surrounded by one or more monofilaments comprising a lower tack styrenic block copolymer or a fiber of differing chemical composition. The differing chemistry exhibits lower tack and fiber spinnability.

In another aspect, the mono or multi-filament fibers made out of high flow styrenic block copolymer-containing compositions undergo a covering process on-line during fiber spinning where the said fibers are wrapped around or covered with nylon or polyester fibers. Nylon or polyester fibers are very strong, and hence protect the inventive fibers during apparel manufacturing. The one step high flow styrenic block copolymer-containing fiber spinning and covering process also prevents the high flow styrenic block copolymer-containing fibers from sticking to each other once wound and make it easy to unwind the fibers during apparel manufacturing.

In various embodiments, compositions have desirable area drawn down ratios (DDR), generally greater than 25:1, greater than 50:1 or 200:1, and even greater than 350:1 or 400:1 in some embodiments.

The compositions of the invention, and constructs formed therefrom, include a selectively hydrogenated, high flow styrenic block copolymer having an ODT temperature that allows processing of the composition utilizing standard processing equipment and parameters used to create fibers. The ODT temperature of the high flow styrenic block copolymer of the present invention is at typically less than about 280° C. or less than 250° C., and less than 200° C. in one embodiment.

In one aspect, a fiber is disclosed formed from a composition comprising a high flow styrenic block copolymer, the high flow styrenic block copolymer being a selectively hydrogenated styrene-diene-styrene or a selectively hydrogenated controlled distribution styrene-diene/styrene-styrene, wherein one or more of the following conditions are present a) the high flow styrenic block copolymer has an ODT temperature of less than 280° C. and b) the composition has ODT temperature of less than 250° C.; and a detackifier. Stated in another manner, the composition comprises i) a high flow styrenic block copolymer having an ODT temperature of less than 280° C. or ii) the composition has an ODT temperature of less than 250° C., or iii) the composition comprises both the high flow styrenic block copolymer having an ODT temperature of less than 280° C. and the composition has an ODT temperature of less than 250° C.

In another aspect, a fiber is disclosed formed from a composition comprising a high flow styrenic block copolymer, the high flow styrenic block copolymer being a selectively hydrogenated styrene-diene-styrene or a selectively hydrogenated controlled distribution styrene-diene/styrene-styrene, wherein one or more of the following conditions are present a) the high flow styrenic block copolymer has an ODT temperature of less than 280° C. and b) the composition has ODT temperature of less than 250° C.; and one or more of a polyolefin (co)polymer, a polystyrene (co)polymer, a detackifier, and a softener, wherein the high flow styrenic block copolymer is present in an amount greater than 50 parts by weight based on the total weight of polymer present in the composition.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

In this specification, all numbers disclosed herein designate a set value, individually, in one embodiment, regardless of whether the word "about" or "approximate" or the like is used in connection therewith. In addition, when the term such as "about" or "approximate" is used in conjunction with a value, the numerical range may also vary, for example by 1%, 2%, or 5%, or more in various other, independent, embodiments. All ranges set forth in the specification and claims not only the end point of the ranges but also every conceivable number between the end point of the ranges.

The number average molecular weight, weight average molecular weight, and distribution of any type of styrenic block copolymer (SBC) or other polymer described in this application are measured by gel permeation chromatography (GPC). The SBC is dissolved in a suitable solvent, such as THF, (typically 0.001-0.010 wt. %), and an appropriate quantity is injected into a GPC device. One suitable GPC device is available from Waters of Milford, Mass. as a Waters Breeze Dual Pump LC. The GPC analysis is performed at an appropriate elution rate (1 to 10 ml/min). The molecular weight distribution is characterized by the signals from a refractive index detector, and number average molecular weights and weight average molecular weights are calculated using a calibration curve generated from a series of narrow molecular weight distribution polystyrenes with peak molecular weights of 500 to 1,000,000 as standard.

The term "polymer" and "(co)polymer", as used herein, refer to a polymeric compound prepared by polymerizing monomers whether of the same or a different type. As used herein, said terms embrace the terms "homopolymer", "copolymer", "terpolymer" and "interpolymer". The term "interpolymer" as used herein refers to polymers prepared by the polymerization of at least two different types of monomers.

Figure 1:
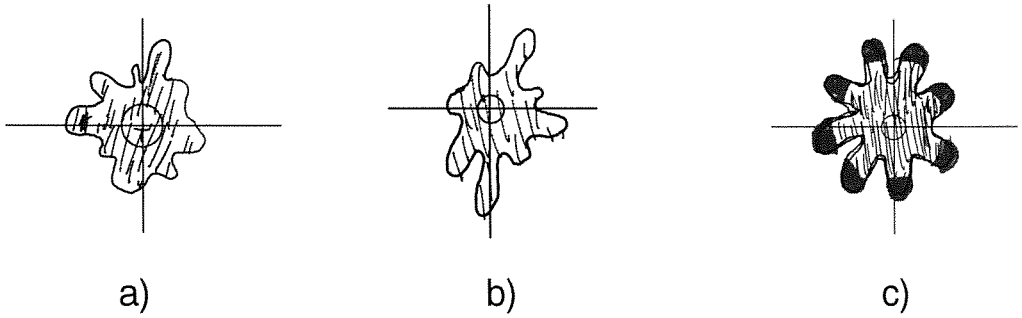
FIG. 1 *a*)-c) illustrate embodiments of fibers having various lobe structures resulting in irregular cross-sectional geometries that are symmetric or skewed from a central axis of the fiber.

The term "fiber", as used herein, refers to one or more of i) a monofilament or single strand construction, for example, but not limited to, being produced by using a die with a single orifice and ii) a multi-filament or multi-strand construction, for example, but not limited to, produced by using a die with multiple holes. Multi-filament or multi-strand constructions can have monofilaments that are in physical contact at at least one location or can be at least partially bonded to each other. The term "fiber" is not limited to any specific profile or geometry. Non-limiting examples of fibers are disclosed in FIGS. 1, 2 and 3.

As set forth herein, ODT temperature ($T_{ODT}$) is measured using dynamic mechanical analysis (DMA). When utilized herein, the $T_{ODT}$ is defined as the temperature above which styrene end blocks are not phase separated and the block copolymers exists as a homogenous melt. ODT temperature ($T_{ODT}$) is the onset temperature at which the storage modulus (G') of the polymer drops, sometimes dramatically, and flow of polymer is dominated by viscous component.

Figure 4:
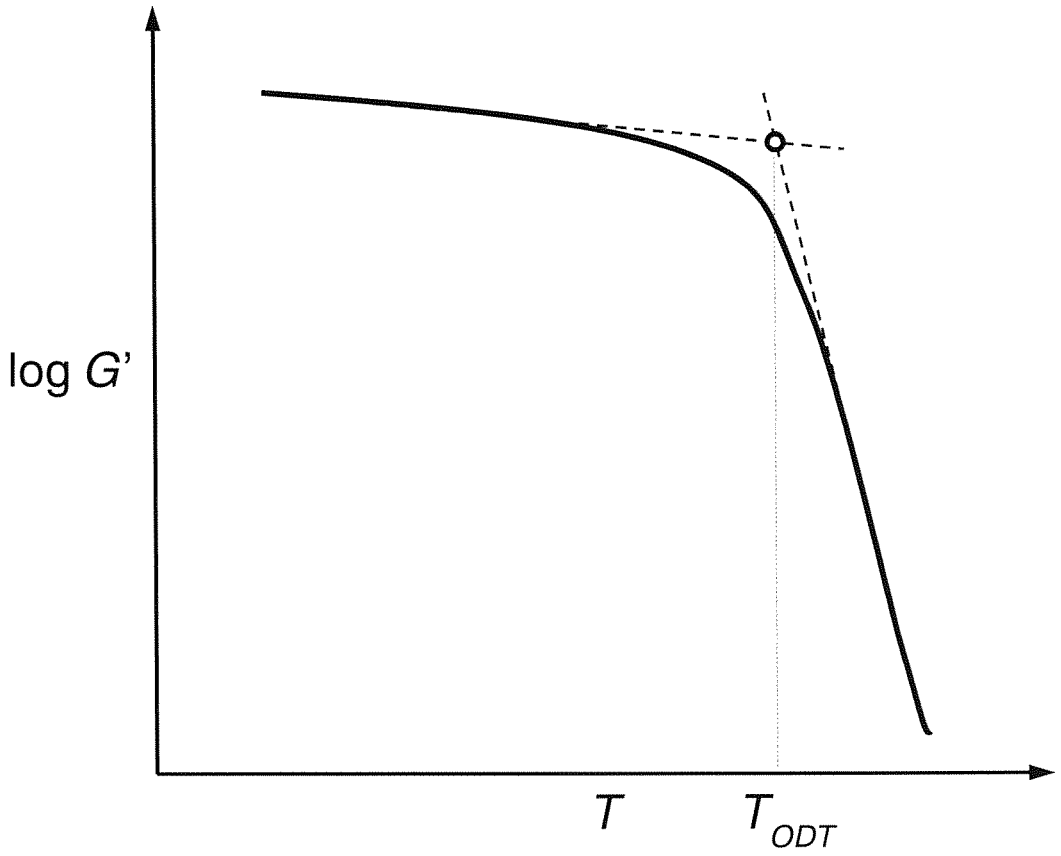
FIG. 4 graphically illustrates a hypothetical example showing determination of order disorder transition temperature.

The test is performed in a temperature ramp mode using 25 mm parallel plate geometry. The test involves measuring the storage modulus (G') at low constant frequency while varying the sample temperature (T). The temperature was varied at a rate of 3° C. per minute. Frequency utilized was 1.25 rad/s. Strain was 0.02%. Suitable instrumentation is available from TA instruments as a Discovery HR-1 hybrid rheometer. For purposes of this application, the temperature at the intersection of the two best-fit lines was chosen as $T_{ODT}$, with the first line approximating the storage modulus prior to a storage modulus decrease and the second line approximating the decrease in storage modulus such as illustrated in FIG. 4. The $T_{ODT}$ should not be confused with the glass transition temperature of the styrenic blocks of SBC (~100° C.) as $T_{ODT}$ is usually above Tg of styrenic block.

The present invention relates to compositions suitable for forming fibers and films that include at least one high melt flow rate styrenic block copolymer having a hydrogenated or saturated midblock and a melt flow rate of at least 3 g/10 min in some embodiments or at least 100 g/10 min in additional embodiments at 230° C. under 2.16 kg mass according to ASTM D1238. In additional embodiments, the compositions include at least one other a) polyolefin-based (co)polymer comprising one or more of a polyolefin by itself as well, polyolefin (co)polymer, polyolefin plastomer and polyolefin elastomer and/or b) polystyrene (co)polymer and/or a softener. Melt flow rate depends on the structure of the block copolymer, hence the wide variation in range.

High Flow Rate Styrenic Copolymer

The high flow styrenic block copolymers have at least one hard block (A) including aromatic vinyl or mono-alkenyl arene repeat units and at least one soft or rubbery polymer block (B) containing two or more repeat units that are the same or different, and independently derived from olefin monomers, such as dienes. The styrenic block copolymer can be, for example, a triblock copolymer (A-B-A); or a tetrablock or higher multiblock copolymer. In a preferred embodiment, the styrenic block copolymer is a triblock copolymer (A-B-A) having two hard blocks.

Each hard polymer block (A) can have two or more same or different aromatic vinyl repeat units. For example, the block copolymer may contain (A) blocks which are styrene/alpha-methylstyrene copolymer blocks or styrene/butadiene random or tapered copolymer blocks so long as a majority of the repeat units of each hard block are aromatic vinyl repeat units. The (A) blocks are aromatic vinyl compound homopolymer blocks in one embodiment. The term "aromatic vinyl" is to include those of the benzene series, such as styrene and its analogs and homologs including o-methylstyrene, p-methylstyrene, p-tert-butylstyrene, 1,3-dimethylstyrene, alpha-methylstyrene and other ring alkylated styrenes, particularly ring-methylated styrenes, and other monoalkenyl polycyclic aromatic compounds such as vinyl naphthalene, vinyl anthracene and the like. The preferred aromatic vinyl compounds are monovinyl monocyclic aromatics, such as styrene and alpha-methylstyrene, with styrene being most preferred. When three or more different repeat units are present in hard polymer block (A), the units can be combined in any form, such as random form, block form and tapered form.

Optionally, the hard polymer block (A) can comprise small amounts of structural units derived from other copolymerizable monomers in addition to the structural units derived from the aromatic vinyl compounds. The proportion of the structural units derived from other copolymerizable monomers is desirably 30% by weight or less and preferably 10% by weight or less based on the total weight of the hard polymer block (A). Examples of other copolymerizable monomers include, but are not limited to, 1-butene, pentene, hexene, conjugated dienes such as butadiene or isoprene, methyl vinyl ether, and other monomers.

The soft polymer block (B) of the styrenic block copolymer includes two or more same or different structural units. Soft polymer block (B) can be derived from olefin monomers generally having from 2 to about 12 carbon atoms and can include, for example, ethylene, propylene, butylene, isobutylene, etc. When the soft polymer block (B) has structural units derived from three or more repeat units, the structural units may be combined in any form such as random, tapered, block or any combination thereof. In one embodiment, the soft polymer block does not contain any unsaturated bonds.

In additional embodiments of the present invention, the styrenic block copolymer can have at least one soft polymer block (B) including two or more repeat units that are the same or different, independently derived from one or more of an olefin monomer and a diene monomer. When the diene monomer is present, the styrenic block copolymer is preferably hydrogenated or substantially hydrogenated. The conjugated diene monomers preferably contain from 4 to about 8 carbon atoms with examples including, but not limited to, 1,3-butadiene (butadiene), 2-methyl-1,3-butadiene (isoprene), 2,3-dimethyl-1,3-butadiene, 1,3-pentadiene (piperylene), 1,3-hexadiene, and the like. Therefore, in one embodiment, the soft polymer block (B) can have structural units derived from one or more of an olefin monomer(s) and diene monomer(s). As indicated hereinabove, when the soft polymer block (B) has structural units derived from three or more repeat units, the structural units may be combined in any form.

Optionally, the soft polymer block (B) can include small amounts of structural units derived from other copolymerizable monomers in addition to the structural units described. In this case, the proportion of the other copolymerizable monomers is generally 30% by weight or less, and preferably 10% by weight or less based on the total weight of the soft polymer block (B) of the styrenic block copolymer. Examples of other copolymerizable monomers include, for example, styrene, p-methylstyrene, methylstyrene, and other monomers that can undergo ionic polymerization.

The styrenic block copolymers may be prepared utilizing bulk, solution or emulsion or other techniques as known in the art.

Other important starting materials for anionic co-polymerizations include one or more polymerization initiators. In the present invention such include, for example, alkyl lithium compounds and other organolithium compounds such as s-butyllithium, n-butyllithium, t-butyllithium, amyllithium and the like, including di-initiators such as the di-sec-butyl lithium adduct of m-diisopropenyl benzene. Other such di-initiators are disclosed in U.S. Pat. No. 6,492,469. Of the various polymerization initiators, s-butyllithium is preferred. The initiator can be used in the polymerization mixture (including monomers and solvent) in an amount calculated on the basis of one initiator molecule per desired polymer chain. The lithium initiator process is well known and is described in, for example, U.S. Pat. Nos. 4,039,593 and Re. 27,145, which descriptions are incorporated herein by reference.

The solvent used as the polymerization vehicle may be any hydrocarbon that does not react with the living anionic chain end of the forming polymer, is easily handled in commercial polymerization units, and offers the appropriate solubility characteristics for the product polymer. For example, non-polar aliphatic hydrocarbons, which are generally lacking in ionizable hydrogens make particularly suitable solvents. Frequently used are cyclic alkanes, such as cyclopentane, cyclohexane, cycloheptane, and cyclooctane, all of which are relatively non-polar. Other suitable solvents will be known to one skilled in the art and can be selected to perform effectively in a given set of process conditions, with temperature being one of the major factors taken into consideration.

Preparation of radial (branched) polymers requires a post-polymerization step called "coupling". It is possible to have either a branched selectively hydrogenated block copolymer and/or a branched tailored softening modifier. In the above radial formula for the selectively hydrogenated block copolymer, n is an integer of from 2 to about 30, preferably from about 2 to about 15, and X is the remnant or residue of a coupling agent. A variety of coupling agents are known in the art and include, for example, dihalo alkanes, silicon halides, siloxanes, multifunctional epoxides, silica compounds, esters of monohydric alcohols with carboxylic acids, (e.g., dimethyl adipate) and epoxidized oils. Star-shaped polymers are prepared with polyalkenyl coupling agents as disclosed in, for example, U.S. Pat. Nos. 3,985,830; 4,391,949; and 4,444,953; Canadian Pat. No. 716,645. Suitable polyalkenyl coupling agents include divinylbenzene, and preferably m-divinylbenzene. Preferred are tetra-alkoxysilanes such as tetra-ethoxysilane (TEOS) and tetra-methoxysilane, alkyl-trialkoxysilanes such as methyl-trimethoxy silane (MTMS), aliphatic diesters such as dimethyl adipate and diethyl adipate, and diglycidyl aromatic epoxy compounds such as diglycidyl ethers deriving from the reaction of bis-phenol A and epichlorohydrin.

Coupling efficiency is of importance in the synthesis of block copolymers, which copolymers are prepared by a linking technology. In a typical anionic polymer synthesis, prior to the coupling reaction, the unlinked arm has only one hard segment (typically polystyrene). Two hard segments are required in the block copolymer if it is to contribute to the strength mechanism of the material. Uncoupled arms dilute the strength forming network of a block copolymer that weakens the material. The very high coupling efficiency realized in the present invention is key to making high strength, coupled, block copolymers.

Another important aspect is to control the microstructure or vinyl content of the conjugated diene in the B block. The term "vinyl" has been used to describe the polymer product that is made when 1,3-butadiene is polymerized via a 1,2-addition mechanism. The result is a monosubstituted olefin group pendant to the polymer backbone, a vinyl group. In the case of anionic polymerization of isoprene, insertion of the isoprene via a 3,4-addition mechanism affords a geminal dialkyl C=C moiety pendant to the polymer backbone. The effects of 3,4-addition polymerization of isoprene on the final properties of the block copolymer will be similar to those from 1,2-addition of butadiene. When referring to the use of butadiene as the conjugated diene monomer, it is preferred that about 10 to 80 mol percent of the condensed butadiene units in the polymer block have a 1,2-addition configuration. Preferably, from about 30 to about 80 mol percent of the condensed butadiene units should have 1,2-addition configuration. When referring to the use of isoprene as the conjugated diene, it is preferred that about 5 to 80 mol percent of the condensed isoprene units in the block have 3,4-addition configuration. Polymer microstructure (mode of addition of the conjugated diene) is effectively controlled by addition of an ether, such as diethyl ether, a diether such as 1,2-diethoxypropane, or an amine as a microstructure modifier to the diluent. Suitable ratios of microstructure modifier to lithium polymer chain end are disclosed and taught in U.S. Pat. No. Re. 27,145.

It is well known in the art to modify the polymerization of the conjugated diene block to control the vinyl content. Broadly, this can be done by utilizing an organic polar compound such as ether, including cyclic ethers, polyethers and thioethers or an amine including secondary and tertiary amines. Both non-chelating and chelating polar compounds can be used.

Among the polar compounds which may be added in accordance with the one aspect of this invention are dimethyl ether, diethyl ether, ethyl methyl ether, ethyl propyl ether, dioxane, dibenzyl ether, diphenyl ether, dimethyl sulfide, diethyl sulfide, tetramethylene oxide (tetrahydrofuran), tripropyl amine, tributyl amine, trimethyl amine, triethyl amine, pyridine and quinoline and mixtures thereof.

In the present invention "chelating ether" means an ether having more than one oxygen as exemplified by the formula $R(OR')_m(OR'')_o$, OR where each R is individually selected from 1 to 8, preferably 2 to 3, carbon atom alkyl radicals; R' and R" are individually selected from 1 to 6, preferably 2 to 3, carbon atom alkylene radicals; and m and o are independently selected integers of 1-3, preferably 1-2. Examples of preferred ethers include diethoxypropane, 1,2-dioxyethane (dioxo) and 1,2-dimethyoxyethane (glyme). Other suitable materials include $CH_3OCH_2CH_2OCH_2CH_2OCH_3$ ($C_6H_{14}O_3$-diglyme) and $CH_3CH_2OCH_2CH_2OCH_2CH_2$—$OCH_2CH_3$ "Chelating amine" means an amine having more than one nitrogen such as N,N,N',N'-tetramethylethylene diamine.

The amount of polar modifier is controlled in order to obtain the desired vinyl content in the conjugated diene block. The polar modifier is used in an amount of at least 0.1 moles per mole of lithium compound, preferably 1-50, more preferably 2-25, moles of promoter per mole of the lithium compound. Alternatively, the concentration can be expressed in parts per million by weight based on the total weight of solvent and monomer. Based on this criteria from 10 parts per million to about 1 weight percent, preferably 100 parts per million to 2000 parts per million are used. This can vary widely, however, since extremely small amounts of some of the preferred modifiers are very effective. At the other extreme, particularly with less effective modifiers, the modifier itself can be the solvent. Again, these techniques are well known in the art, disclosed for instance in Winkler, U.S. Pat. No. 3,686,366 (Aug. 22, 1972), Winkler, U.S. Pat. No. 3,700,748 (Oct. 24, 1972) and Koppes et al, U.S. Pat. No. 5,194,535 (Mar. 16, 1993), the disclosures of which are hereby incorporated by reference.

Hydrogenation can be carried out via any of the several hydrogenation or selective hydrogenation processes known in the prior art. For example, such hydrogenation has been accomplished using methods such as those taught in, for example, U.S. Pat. Nos. 3,595,942; 3,634,549; 3,670,054; 3,700,633; and Re. 27,145, the disclosures of which are incorporated herein by reference. These methods operate to hydrogenate polymers containing aromatic or ethylenic unsaturation and are based upon operation of a suitable catalyst. Such catalyst, or catalyst precursor, preferably comprises a Group VIII metal such as nickel or cobalt which is combined with a suitable reducing agent such as an aluminum alkyl or hydride of a metal selected from Groups I-A, H-A and III-B of the Periodic Table of the Elements, particularly lithium, magnesium or aluminum. This preparation can be accomplished in a suitable solvent or diluent at a temperature from about 20° C. to about 80° C. Other catalysts that are useful include titanium based catalyst systems.

One embodiment of selectively hydrogenated controlled distribution styrene-diene/styrene-styrene block copolymers applied in the present invention have been described in U.S. Pat. No. 7,169,848 to Bening et al. These block copolymers have mixed monomer rubbery (A) blocks (conjugated diene/mono alkenyl arene) which are made by the combination of a unique control for the monomer addition and the use of diethyl ether or other modifiers as a component of the solvent (which will be referred to as "distribution agents") which results in a certain characteristic distribution of the two monomers (herein termed a "controlled distribution" polymerization, i.e., a polymerization resulting in a "controlled distribution" structure), and also results in the presence of certain mono alkenyl arene rich regions and certain conjugated diene rich regions in the polymer block. For purposes hereof, "controlled distribution" is defined as referring to a molecular structure having the following attributes:

(1) terminal regions adjacent to the mono alkenyl arene homopolymer ("A") blocks that are rich in (i.e., having a greater than average amount of) conjugated diene units; (2) one or more regions not adjacent to the A blocks that are rich in (i.e., having a greater than average amount of) mono alkenyl arene units; and (3) an overall structure having relatively low blockiness. For the purposes hereof, "rich in" is defined as greater than the average amount, preferably greater than 5% the average amount. This relatively low blockiness can be shown by either the presence of only a single glass transition temperature ("Tg,") intermediate between the Tg's of either monomer alone, when analyzed using differential scanning calorimetry ("DSC") thermal methods or via mechanical methods, or as shown via proton nuclear magnetic resonance ("H-NMR") methods. The potential for blockiness can also be inferred from measurement of the UV-visible absorbance in a wavelength range suitable for the detection of polystyryllithium end groups during the polymerization of the B block. A sharp and substantial increase in this value is indicative of a substantial increase in polystyryllithium chain ends. In this process, this will only occur if the conjugated diene concentration drops below the critical level to maintain controlled distribution polymerization. Any styrene monomer that is present at this point will add in a blocky fashion. The term "styrene blockiness", as measured by those skilled in the art using proton NMR, is defined to be the proportion of S units in the polymer having two S nearest neighbors on the polymer chain. The styrene blockiness is determined after using H-1 NMR to measure two experimental quantities as follows:

First, the total number of styrene units (i.e. arbitrary instrument units which cancel out when ratioed) is determined by integrating the total styrene aromatic signal in the H-1 NMR spectrum from 7.5 to 6.2 ppm and dividing this quantity by 5 to account for the 5 aromatic hydrogens on each styrene aromatic ring.

Second, the blocky styrene units are determined by integrating that portion of the aromatic signal in the H-1 NMR spectrum from the signal minimum between 6.88 and 6.80 to 6.2 ppm and dividing this quantity by 2 to account for the two ortho hydrogens on each blocky styrene aromatic ring. The assignment of this signal to the two ortho hydrogens on the rings of those styrene units which have two styrene nearest neighbors was reported in F. A. Bovey, High Resolution NMR of Macromolecules (Academic Press, New York and London, 1972), Chapter 6. The styrene blockiness is simply the percentage of blocky styrene to total styrene units:

Blocky %=100 times (Blocky Styrene Units/Total Styrene Units)

Expressed thus, Polymer-Bd-S—$(S)_n$—S-Bd-Polymer, where n is greater than zero is defined to be blocky styrene. For example, if n equals 8 in the example above, then the blockiness index would be 80%. It is preferred that the blockiness index be less than about 40. For some polymers, having styrene contents of ten weight percent to forty weight percent, it is preferred that the blockiness index be less than about 10.

Hydrogenation can be carried out under such conditions that at least about 90% of the conjugated diene double bonds have been reduced, and between zero and 10% of the arene double bonds have been reduced. Preferred ranges are at least about 95% of the conjugated diene double bonds reduced, and more preferably about 98% of the conjugated diene double bonds are reduced. Alternatively, it is possible to hydrogenate the polymer such that aromatic unsaturation is also reduced beyond the 10% level mentioned above. Such exhaustive hydrogenation is usually achieved at higher temperatures. In that case, the double bonds of both the conjugated diene and arene may be reduced by 90% or more.

Once the hydrogenation is complete, it is preferable to extract the catalyst by stirring with the polymer solution a relatively large amount of aqueous acid (preferably 20-30 percent by weight), at a volume ratio of about 0.5 parts aqueous acid to 1 part polymer solution. Suitable acids include phosphoric acid, sulfuric acid and organic acids. This stirring is continued at about 50° C. for about 30 to about 60 minutes while sparging with a mixture of oxygen in nitrogen. Care must be exercised in this step to avoid forming an explosive mixture of oxygen and hydrocarbons.

The high flow styrenic block copolymers of the present invention are characterized further by having a melt flow rate in some embodiments of greater than or equal to 3 g/10 min or 100 g/10 min at 230° C. under 2.16 kg mass, desirably greater than or equal to 150 g/10 min at 230° C. under 2.16 kg mass, and preferably greater than 200 g/10 min at 230° C. under 2.16 kg mass as measured according to ASTM D1238. In other embodiments the high flow styrenic block copolymers are characterized as having a melt flow rate between 3 and 15 g/10 min at 230° C. under 2.16 kg mass, desirably between 4 g/10 min and 10 g/10 min and preferably around 7 g/10 min at 230° C. under 2.16 kg mass as measured according to ASTM D1238.

In various embodiments, the styrene or mono-alkenyl arene content of the high flow styrenic block copolymer is from about 10 to about 50 weight percent, desirably between about 13 to about 40 or 45 percent and preferably from about 15 to about 35 percent.

Beneficially, the high flow styrenic block copolymers of the present invention have a relatively low ODT temperature. The ODT temperature of the block copolymers is generally less than about 280° C., desirably less than about 250° C. and preferably less than 220° C. Above 280° C., polymers can be more difficult to process. In a preferred embodiment, the ODT temperature ranges from about 170° C. to about 210° C.

In some embodiments the high flow styrenic block copolymer has a number average molecular weight that ranges generally from about 30,000 to about 130,000 and preferably from about 45,000 to 110,000 g/m.

Hydrogenated or selectively hydrogenated high flow styrenic block copolymers with relatively low ODT temperatures are available in the art from sources such as Kraton Polymers of Houston, Tex., as MD1648™, MD1653™ and TSRC Corporation and Dexco Polymers of Houston, Tex. as DP-014™.

The amount of the one or more high flow styrenic block copolymers utilized in the compositions, and constructs produced therewith, of the present invention ranges generally from about 10 to about 90 parts, desirably from about 25 to about 90 parts and preferably from about 30 to about 80 parts based 100 parts by weight of the composition. The high flow styrenic block copolymers are present in a major amount based on the total weight of any polymers utilized in the compositions.

Other Polymers

In some embodiments, at least one other polymer is utilized in the compositions of the present invention that are used to form desired articles such as fibers and films, as mentioned herein. Representative polymers include, but are not limited to polyolefin-based polymers such as general polyolefins, polyolefin plastomers and polyolefin elastomers, as well as polystyrenes.

Polyolefin-Based Polymers

Polyolefins suitable for use in the compositions of the present invention comprise amorphous or crystalline homopolymers or copolymers of two or more same or different monomers derived from alpha-monoolefins having from 2 to about 12 carbon atoms, and preferably from 2 to about 8 carbon atoms. Examples of suitable olefins include ethylene, propylene, 1-butene, 1-pentene, 1-hexene, 2-methyl-1-propene, 3-methyl-1-pentene, 4-methyl-1-pentene, 5-methyl-1-hexene, and combinations thereof. Polyolefins include, but are not limited to, low-density polyethylene, high-density polyethylene, linear-low-density polyethylene, polypropylene (isotactic and syndiotactic), ethylene/propylene copolymers, and polybutene, ultra or very low density polyethylene, medium density polyethylene, high pressure low density polyethylene, ethylene/alpha olefin copolymers, propylene/alpha olefin copolymers. Polyolefin copolymers can also include the greater part by weight of one or more olefin monomers and a lesser amount of one or more non-olefin monomers such as vinyl monomers including vinyl acetate, or a diene monomer, etc. Polar polyolefin polymers include ethylene acrylate and ethylene vinyl acetate, for example. Generally, a polyolefin copolymer includes less than 40 weight percent of a non-olefin monomer, desirably less than 30 weight percent, and preferably less than about 10 weight percent of a non-olefin monomer.

In a further embodiment, the polyolefin can include at least one functional group per chain or can be a blend of non-functionalized polyolefins and functionalized polyolefins. Functional groups can be incorporated into the polyolefin by the inclusion of for example, one or more non-olefin monomers during polymerization of the polyolefin. Examples of functional groups include, but are not limited to, anhydride groups such as maleic anhydride, itaconic anhydride and citraconic anhydride; acrylates such as glycidyl methacrylate; acid groups such as fumaric acid, itaconic acid, citraconic acid and acrylic acid; epoxy functional groups; and amine functional groups. Functional group-containing polyolefins and methods for forming the same are well known to those of ordinary skill in the art. Functionalized polyolefins are available commercially from sources such as Uniroyal, Atofina, and DuPont. Epoxy modified polyethylenes are available from Atofina as LOTADER®. Acid modified polyethylenes are available from DuPont as FUSABOND®.

Polyolefin polymers and copolymers are commercially available from sources including, but not limited to, Chevron, Dow Chemical, DuPont, ExxonMobil, Huntsman Polymers, Mitsui Chemicals Group, Ticona and Westlake Polymer under various designations. Ethylene/alpha olefin copolymers and propylene/alpha olefin copolymers are commercially available as INFINITY®, ENGAGE® and VERSIFY® from Dow Chemical, TAFMER® from Mitsui Chemicals Group, and EXACT® and VISTAMAXX® polymers from Exxon Mobil.

When present, the polyolefins range in an amount generally from about 1 to about 80 parts, desirably from about 5 to about 70 parts, and preferably from about 10 to about 50 parts based on 100 total parts by weight of the composition.

Typical high melt flow polyolefin (co)polymers are preferred for fiber spinning compounds for example >12 g/10 min at 230° C. under 2.16 kg mass as measured according to ASTM D1238. In one embodiment, polypropylene of MFI of about 1500 g/10 min at 230° C. under 2.16 kg mass as measured with a modified die with 0.0825 inch ID.

Polyolefin (co)polymers utilized in the present invention have a melt flow rate of generally at least 10 g/10 min at 230° C. under 2.16 kg mass as measured according to ASTM D1238, and desirably greater than at least 12 g/10 min at 230° C. under 2.16 kg mass as measured according to ASTM D1238.

Olefin Block Copolymers

As mentioned above, in various embodiments the compositions may comprise an olefin or olefin block copolymer (OBC).

The olefin block copolymer contains therein two or more, and preferably three or more segments or blocks. Generally olefins having from 2 to about 12 carbon atoms and preferably from about 2 to about 8 carbon atoms are utilized. The olefin block copolymers can comprise alternating blocks of hard and soft segments. As known in the art, chain or catalytic shuttling technology allows variable yet controllable distribution of block lengths to be produced. Olefin block copolymers are characterized by having a broader molecular weight distribution compared to traditional anionic block copolymers made by a living polymerization.

Olefin block copolymers are available for example Dow as INFUSE®. Further description of olefin block copolymers is set forth in WO 2005/090425; WO 2005/090427; WO 2005/090426; U.S. 2007/0219334; U.S. 20100069574; U.S. 20100298515; U.S. Pat. No. 5,844,045; U.S. Pat. No. 5,869,575; U.S. Pat. No. 6,448,341; U.S. Pat. No. 6,538,070; U.S. 6,545,088; U.S. Pat. No. 6,566,446; U.S. Pat. No. 7,608,668; and U.S. Pat. No. 7,671,106 herein fully incorporated by reference.

When utilized, the olefin block copolymers are present in an amount generally from about 1 to about 80 parts, desirably from about 5 to about 70 parts and preferably from about 10 to about 50 parts by weight based on 100 total parts by weight of the composition.

Styrene (Co)Polymers

Styrene (co)polymers can be utilized in the present invention as noted hereinabove. Styrenic (co)polymers include monomer units of aromatic vinyl compounds which have been defined hereinabove. Optionally styrene (co)polymers can comprise small amounts of structurally units derived from other (co)polymerizable monomers in addition to the structural units derived from the aromatic vinyl compounds. The proportion of structural units derived from other copolymerizable monomers is desirably 30 percent by weight or less and preferably 15 percent by weight or less based on the total weight of the styrene (co)polymer. Examples of other copolymerizable monomers include, but are not limited to, conjugated diene such butadiene or isoprene, butene, pentene, hexene, and methyl vinyl ether. Polystyrene and high impact polystyrene are nonlimiting examples.

Polystyrene (co)polymers are commercially available from sources including, but not limited to, INEOS Styrolution of Frankfurt am Main, Germany as Styrolution®PS resins.

When utilized, the styrenic polymers are present in an amount generally from about 1 to about 50 parts, desirably from about 5 to about 40 parts, and preferably from about 10 to about 35 parts based on 100 total parts of the composition.

Detackifier

In various embodiments, the compositions of the present invention include at least one detackifier. Beneficially the detackifier serves as a lubricant and reduces the tack of the fibers formed from compositions of the present invention. The detackifier can be present in the composition utilized to form the fibers and/or be applied to the fibers after creation, for example as a spin finish applied on-line.

Examples of detackifiers include, but are not limited to, fluoropolymers, siloxanes, fatty amides, metal stearates and silicone such as silicone oil. Mixtures of detackifiers can be utilized in various embodiments. Perfluoropolyethers are preferred in one embodiment. Calcium stearate is utilized in another embodiment. Detackifiers are available from companies such as Goulston as Lurol SF-15413™, AK Additives Inc. as Aksab CA-35 FD™, and Chemours as Fluoroguard™, in particularly Fluoroguard Pro™.

The detackifiers are present in an amount generally from about 0.1 to about 25 parts, and preferably from about 0.2 to about 15 parts based on 100 total parts by weight of the composition.

Softener

The compositions of the present invention, in various embodiments optionally include a softener such as a mineral oil softener, or synthetic resin softener, a plasticizer, a biorenewable softener such as vegetable oil, or combinations thereof. Various biorenewable softeners are disclosed for example in U.S. Publication 2014/0100311, herein incorporated by reference. The softener can beneficially reduce the $T_{ODT}$ and the temperatures at which the compositions are processable. Oil softeners are generally mixes of aromatic hydrocarbons, naphthene hydrocarbons and paraffin, i.e., aliphatic, hydrocarbons. Those in which carbon atoms constituting paraffin hydrocarbons occupy 50% by number or more of the total carbon atoms are called "paraffin oils". Those in which carbon atoms constituting naphthene hydrocarbons occupy 30 to 45% by number of the total carbon atoms are called "naphthene oils", and those in which carbon atoms constituting aromatic hydrocarbons occupy 35% by number or more of the total carbon atoms are called "aromatic oils". In one embodiment, paraffin oils and/or plasticizers are preferably utilized as a softener in compositions of the present invention. Examples of synthetic resin softeners include, but are not limited to, polyisobutylene, and polybutenes. When present, the softener is utilized in an amount generally from about 1 to about 100 parts, desirably from about 5 to about 50 parts and preferably from about 10 to about 40 parts by weight based on 100 total parts by weight of the high flow styrenic block copolymer.

Additives

The compositions of the present invention may include additional additives including, but not limited to light stabilizers, antioxidants, flame retardant additives, pigments, peroxides, heat stabilizers, processing aids, mold or die release agents, flow enhancing agents, nanoparticles, foam agents, platelet fillers and non-platelet fillers. Examples of fillers for use in the compositions include, but are not limited to, one or more of calcium carbonate, talc, clay, zeolite, silica, titanium dioxide, carbon black, barium sulfate, mica, glass fibers, whiskers, carbon fibers, magnesium carbonate, glass powders, metal powders, kaolin, graphite, and molybdenum disulfide. Suitable fillers also include bio-based fillers, e.g. various fibers, cellulose, and/or lignin.

The compositions of the present invention can be formed by blending the desired components in one or more steps, preferably by mixing. The composition is preferably heated to obtain a melted composition, preferably with mixing, to substantially disperse the components thereof. Melt blending is performed at a temperature generally from about 150° C. to about 250° C., and preferably from about 160° C. to about 240° C. The compositions can be prepared for example in a Banbury, on a two-roll mill, in a continuous mixer such as single screw or twin screw extruder, a kneader, or any other mixing machine as known to those of ordinary skill in the art. After preparation of the compositions, they can be pelletized or diced utilizing appropriate equipment, if desired before further processing.

One method for producing fibers from the compositions of the present invention is as follows. The composition can be melt spun into fibers using a single screw thermoplastic extruder to melt the composition, preferably in the form of pellets or granules. The composition is added to the extruder and extruded preferably through a melt filter and a spinnerette die. The fibers are typically extruded vertically down and preferably air cooled in a continuous process. The fibers are drawn down on multiple wraps of rotating rolls. When a detackifier is utilized in-line, the detackifier can be utilized at any stage after extrusion such as after drawing down. The fibers are collected, such as by a package wind or on a tube core. This process creates molecular orientation in the fiber as it reduces the fiber diameter. The spinnerette die typically has groups of holes to create each filament in a fiber bundle. As the filaments are drawn down, the bundles consolidate and stick together to form a fiber bundle in some embodiments.

Area draw down ratio herein is defined as the ratio of annular exit area of the die to the cross-section area of the final fiber. A larger area draw down ratio enables faster production rates and gives smaller denier fibers. The compositions of the present invention have desirable area draw down ratios, generally greater than 25:1, and desirably greater than 50:1 or 200:1. Draw down ratios of about 400:1 are preferred in some embodiments.

The compositions of the present invention can be utilized to form a variety of constructions including, but not limited to, fibers, films, as well as moldings. Fibers and films can be formed into a large variety of goods such as, but not limited to, wearable apparel, personal hygiene items and durable or disposable goods. Fibers can be prepared by well-known processes such as spunbonding, melt blowing, melt spinning and continuous filament winding techniques. Film and sheet forming processes typically utilize extrusion and coextrusion techniques, for example blown film, cast film, profile extrusion, injection molding, extrusion coating and extrusion sheeting. Fibers prepared from compositions of the present invention have desirable elasticity and modulus. Fibers of the present invention for use in apparel are expected to have very good elasticity and elastic recovery properties with low hysteresis, tensile strength of at least 10 MPa and a 100% modulus of at least 2 MPa in some embodiments.

As mentioned hereinabove, the problems of the prior art are solved by the compositions of the present invention which offer elasticity via multi-functional materials in a single fiber or yarn which has reduced tack. The beneficial contribution of the macroscale material when combined with hard-soft components are evident, yet on the microscale the soft-soft, elastic-elastic combination yields performance attributes in the reduction of tackiness that is typically associated with styrenic block copolymers.

Fiber Characteristics

In one aspect, an embodiment of a fiber monofilament structure is disclosed having various lobe structures resulting in irregular cross-sectional geometries that are symmetric or skewed from the central axis of the fiber. The irregular structure comprises a high flow styrenic block copolymer wherein the composition comprising the styrenic block copolymer contains either/or/and di-blocks, tri-blocks or radial structures. These compositional elements limit the degree of tackiness without destroying elasticity or processability, see FIG. 1 *a*)-c).

Figure 2:
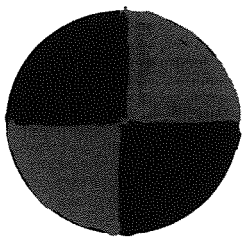
FIG. 2 illustrates a fiber comprising multiple elastomeric materials in direct contact within a single strand.
Figure 3:
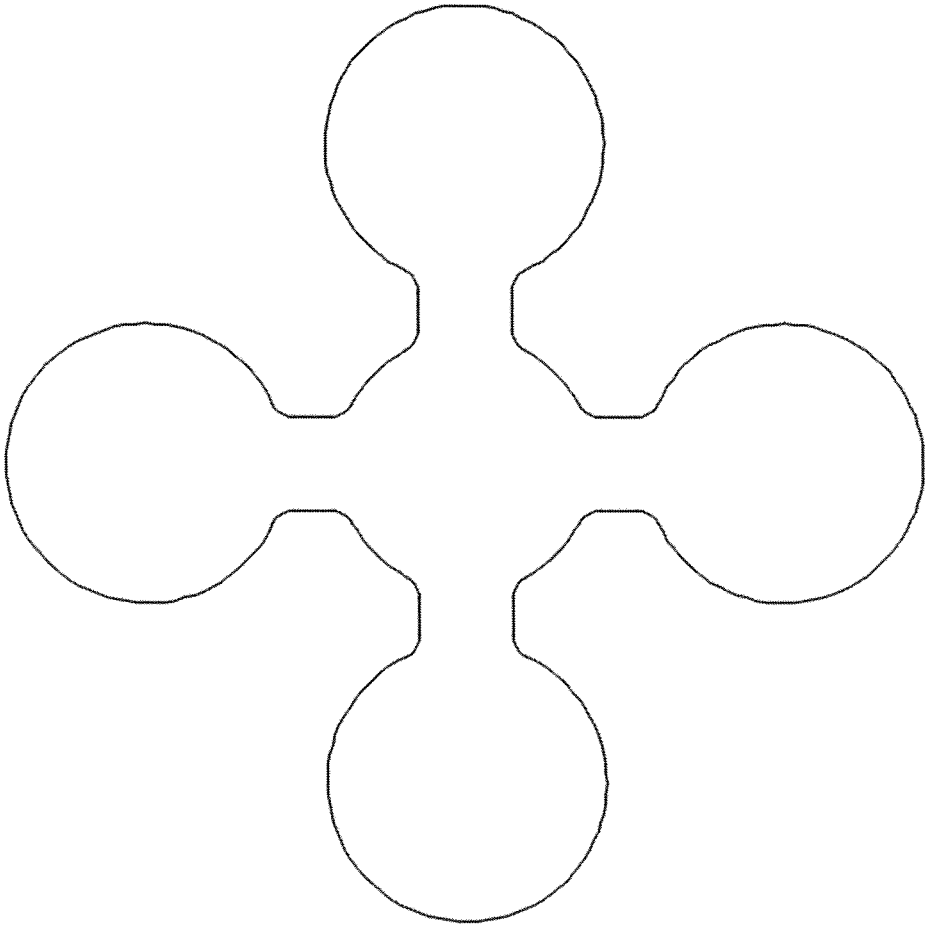
FIG. 3 illustrates a multifilament fiber construction with monofilaments that are in physical contact or partially bonded to each other.

In another aspect, an embodiment of a fiber is disclosed comprising multiple elastomeric materials in direct contact in a single strand or monofilament, see FIG. 2; that is elastic material comprising a high flow styrenic block copolymer wherein the sub fiber component retains a high degree of elasticity and tack; while a second polymer component imparts a buffer zone in addition to remaining part of the sub fiber structure. The complete structure offers high elasticity and low tack.

In another aspect, a fiber is composed of multiple strands in which the monofilament comprising a high flow styrenic block copolymer is surrounded by one or more monofilaments comprising a lower tack styrenic block copolymer or a fiber of differing chemical composition. The differing chemistry exhibits lower tack and fiber spinnability.

In various embodiments, mono- or multifilament fibers formed from the compositions of the present invention can include a covering, such as a coating of another polymer, for example, but not limited to, nylon or polyester. The covering can protect the fiber core during a knitting process and/or strengthen the fiber. Coated fibers can be imparted with a soft or silky feel through the coating process.

High vinyl styrenic block copolymers are known to have a higher level of tack than conventional styrenic block copolymers, see U.S. Publication 2013/0225020 which indicates that high vinyl styrenic block copolymers can be used in adhesives and bonding compounds due to their high tack. Hence, when monofilament or multifilament fibers are spun and wound on a roll, they may be difficult to unwind due to high tack.

The present invention solves the problems of the prior art in one embodiment by application of at least one detackifier, as mentioned above to either the compound prior to spinning or to a formed fiber, such as prior to winding for example on a roll. In still other embodiments a detackifier can be present in the composition prior to forming into a fiber and a detackifier can be added or applied to an outer surface of a formed fiber. In this case, the detackifiers can be the same or different. A post application of a composition is generally known as spin-finish in the art. As such, the detackifier can be part of or comprise a spin-finish composition. In a further embodiment, fibers formed from compositions of the present invention are coated or dusted with talc or a similar material prior to winding.

In yet another embodiment, a slip coating is provided on the fiber during extrusion. For example, the slip coating layer can be a siloxane masterbatch with polyolefin and/or styrenic block copolymer, see for example the slip coating compositions set forth in U.S. Ser. No. 14/944,905 herein fully incorporated by reference. The slip coating layer does not lead to appreciable loss and elasticity of the fiber and helps significantly cut down on tack so that the fibers can be unwound easily from the roll.

The slip coating layer can be applied as follows. The fiber can be air cooled and drawn down slightly. Then, either in line, or in a later operation, the fiber is stretched beyond the elastic limit of the slip coating material, in some embodiments to 100 percent elongation. Stretching causes the slip coat layer to crack or fracture on the fiber and become discontinuous. The discontinuous slip coat layer is still bonded to the elastic fiber. Then, as the fibers stretch and relax, the slip coat layer does not cause additional plastic deformation to occur. The fiber can stretch and relax with minimal plastic deformation as if there were no coating, but the slip coat layer provides a slick or slippery surface on the fiber. The slip coat layer material acts as a lubricant, preventing the fiber from sticking to itself when wound. The slip coating layer also allows the fiber to be woven or knitted into a desired object such as fabric, hosiery, sock, etc.

The coating can be applied in a continuous manner, completely encapsulating the fiber, or can be applied to only a portion of the fiber, such as, but not limited to a series of stripes around the perimeter.

Unwinding force is used as a measure of tack in this application. Fibers with lower unwinding force, come off a package easily and can be easily fed to other machines for post-spinning operations such as knitting or covering. In addition, lower unwinding forces allow for more uniform circular knitting with less scrap generation. If the unwinding force is too high, it is not possible to knit hosiery or socks etc. To measure unwinding force, the fiber package was held with a tube core axis horizontal 90 degrees to a take-up spindle. The take up spindle was positioned approximately 50.8 cm away from the end of the package. The yarn end was wrapped around a approximately 2.54 cm diameter take-up spindle rotating at 950 rpm to unwind at a rate of 76 meters per minute. A handheld digital tension force measurement gauge was used to measure the unwinding tension for 60 seconds per test data point. The instrument used was a MLT Weslo digital yarn meter by Memminger-IRO GmbH. The average tension force was measured in cN. Commercial spandex samples were used as control for the examples set forth below and the unwinding force on the spandex samples was considered a benchmark.

The compositions of the present invention can also be characterized by ODT temperature. The ODT temperature is be measured as set forth hereinabove. The compositions of the present invention in various embodiments have an ODT temperature that is generally less than 250° C., and preferably less than 220° C. ODT is a characteristic transition associated with SBC, however, in a SBC composition, presence of other ingredients such as softeners can impact the temperature at which this transition occurs.

Fibers can be formed in a range of sizes from 70 to 300 denier in one embodiment. Based on their denier, these elastic fibers are used for weaving stretch fabrics and for circular knitting in bare and covered form. Fabrics are used in garments such as stretch pants, swimsuits, athletic wear. Circular knitted garments include panty hose, underwear, socks, etc.

EXAMPLES

The examples set forth below are provided to illustrate the fiber-forming compositions and fibers of the present invention. These examples are not intended to limit the scope of the invention.

Sample Preparation:

The materials of each composition set forth below were mixed to a substantially uniform state and were compounded using a Berstorff ZE 40 twin screw extruder, in a melt process within the temperature range of approximately 148° C. to 205° C. at a screw speed of 150-250 revolutions/minute. Molten strands of extrudate were pulled through a water bath and pelletized using a pelletizer.

Fibers were formed in a melt extrusion process. Pellets were melted in a conventional thermoplastic extruder and travel through an approximately 30.48 cm long×1 cm inner diameter heated hose to a spinneret die for fiber forming, air cooling, and winding into a package. A single screw approximately 1.59 cm diameter vertical thermoplastic extruder with 24:1 length to diameter ratio and a general purpose polyolefin screw were used to melt the pellets and to feed the spinneret. The extruder screw was set at an approximate screw speed of 5 rpm with temperatures ranging from approximately 132° C. to 205° C., based on the formulation being extruded. A 250 mesh stainless steel screen is used in the melt stream just upstream of the fiber spinneret die. The fibers were extruded vertically down through air approximately 114.3 cm to cool then passed through a teflon spin finish applicator guide. A peristaltic pump supplied 3-6% by weight detackifier spin finish to the yarn end through a 0.approximately 23 cm inner diameter silicone tube onto the top of the U shaped teflon guide. This allowed for fiber winding without excessive stretching or breakage and kept the fiber from blocking on the wound package. After application of spin finish, the fibers passed through a brass traversing guide to create about a 10 degree helix angle onto an approximately 8.6 cm outer diameter x 11.4 cm long tube core on a spindle rotating at 950 rpm. This wound the package at around 250 meters per minute.

The following raw materials were utilized in the examples.

TABLE 1

| COMPONENT DESCRIPTION | TRADENAME/SOURCE |
|---|---|
| High Flow SBC 1 | MD1648 ™/Kraton Polymers |
| High Flow SBC 2 | MD1653 ™/Kraton Polymers |
| High Flow SBC 3 | TAIPOL DP-014 ™/TSRC Corp. |
| Polyolefin (co)polymer 1 | Vistamax 6102 ™/Exxon Mobil Corp. |
| Polyolefin (co)polymer 2 | Queo 8210 ™/Borealis AG |
| Polyolefin (co)polymer 3 | Proflow 1000 ™/Polyvisions Inc. |
| Polyolefin (co)polymer 4 | CP360H PP ™/Braskem |
| Styrene (co)polymer 1 | Kristalex 5140 ™/Eastman Chemical |
| Detackifier 1 | Lurol SF-15413 ™/Goulston Tech., Inc. |
| Detackifier 2 | Fluoroguard PRO ™/Chemours Co. |
| Detackifier 3 | Aksab CA-35FD ™/AK Additives Inc. |
| Softener | Puretol PSO550 ™/Petro-Canada Lubricants, Inc. |
| Antioxidant | Irganox 1010 ™/BASF Corp. |
| Stabilizer 1 | Irgafos168 ™/BASF Corp. |
| Stabilizer 2 | Chimassorb 944FD ™/BASF Corp. |
| Stabilizer 3 | Tinuvin 326 ™/BASF Corp. |

Test Methods

The following test protocols were used for testing:

TABLE 2

| Tests | Test Method |
|---|---|
| Specific gravity | ASTM D792 |
| Durometer Hardness (5-s) | ASTM D2240 |
| Melt Flow Rate (170° C./2160 g) | ASTM D1238 |
| Tensile Strength & Elongation at Break | ASTM D412 |
| Tensile Stress, Tensile strength, and elongation at break for Fibers | TA Internal Method |

Unwinding Forces

Formulation and key properties of compounds used in this study:

TABLE 3

| | | Experiment Number | | |
|---|---|---|---|---|
| | | Comparative #1 | Example #1 | Example #2 |
| High Flow SBC 1 | | 100 | 100 | 100 |
| Polyolefin (co)polymer 1 | | — | 20 | 13.33 |
| Polyolefin (co)polymer 3 | | — | 13.33 | 20 |
| Antioxidant | | — | 0.134 | 0.134 |
| Stabilizer 1 | | — | 0.134 | 0.134 |
| Stabilizer 2 | | — | 0.134 | 0.134 |
| Stabilizer 3 | | — | 0.134 | 0.134 |
| Detackifier 3 | | — | 0.134 | 0.134 |
| Total (Wt.) | | 100 | 134 | 134 |
| Specifiv Gravity | | 0.9 | 0.9 | 0.89 |
| Durometer A hardness (5-s) | Shore A | 53 | 61 | 64 |
| Tensile Strength | PSI | 1270 | 970 | 1360 |
| Tensile Elongation | % | 600 | 390 | 600 |

TABLE 4

| Sample | Detackifier (external) used | Average Unwinding Force (cN) |
|---|---|---|
| Spandex 1* | Unknown | 1.5 |
| Spandex 2** | Unknown | 0.2 |
| Comparative #1 | No detackifier | N/A*** |
| Comparative #1 | Detackifier 1 | 2.15 |
| Example #1 | Detackifier 1 | 0.47 |
| Example #1 | Detackifier 2 | 0.87 |
| Example #2 | Detackifier 1 | 0.3 |
| Example # 2 | Detackifier 2 | 0.53 |

*Spandex 1: 120 denier, 902C- 7 filament,
**Spandex 2: 135 deiner, 162b - 8 filament
***Sample broke during unwinding The procedure for making fibers from the samples indicated in Table 3 has been described above. For processing of fibers for the unwinding force example section, a 6 hole spinneret die with diameter of approximately 0.060 cm and length of approximately 0.67 cm was used. The die had a center hole and five equally spaced holes on an approximately 0.254 cm radius. Approximately 1000 to 1200 meters of fiber were wound onto each package. The fibers formed from Comparative #1 and Examples #1 and #2 had a six filament construction with total denier ranging from 130 and 180. Shaft diameter was approximately 2.54 cm. The unwinding force was measured using the procedure described above.

As shown in Table 4, unwinding force could not be measured on fibers of Comparative #1 since the fibers broke during the test. However, addition of an external detackifier helped in reducing tack and allowed the fibers to slide past each other and unwind easily. In addition, fibers of each of the examples had an average unwinding force comparable to the Spandex benchmarks.

Order Disorder Transition (ODT)Temperature

Formulation and key properties of compounds used in this study:

TABLE 5

| | Experiment Number | | | |
|---|---|---|---|---|
| | Comparative #2 | Comparative #3 | Example #3 | Example #4 |
| High Flow SBC 2 | 100 | — | 100 | 100 |
| High Flow SBC 3 | — | 100 | — | — |
| Softener | — | — | 30 | 50 |
| Polyolefin (co)polymer 2 | — | — | — | 20 |
| Styrene (co)polymer 1 | — | — | — | 15 |
| Antioxidant | — | — | 0.131 | 0.185 |
| Stabilizer 1 | — | — | 0.131 | 0.185 |

TABLE 5-continued

| | | Experiment Number | | | |
|---|---|---|---|---|---|
| | | Comparative #2 | Comparative #3 | Example #3 | Example #4 |
| Stabilizer 2 | | — | — | 0.131 | — |
| Stabilizer 3 | | — | — | 0.131 | — |
| Detackifier 3 | | — | — | 0.131 | 0.185 |
| Total (Wt.) | | 100 | 100 | 130.65 | 185.55 |
| Specifiv Gravity | | 0.91 | 0.89 | 0.90 | 0.89 |
| Shore A hardness (5-s) | A | 78 | 66 | 62 | 58 |
| Tensile Strength | psi | 2400 | 1830 | 1050 | 1150 |
| Tensile Elongation | % | 425 | 440 | 460 | 570 |

The $T_{ODT}$'S of the composition set forth in Table 5 were measured and are set forth in Table 6 below:

TABLE 6

| Sample | $T_{ODT}$ (° C.) |
|---|---|
| Comparative #1 | 178 |
| Comparative #2 | 267 |
| Comparative #3 | 237 |
| Example 3 | 202 |
| Example 4 | 202 |

Comparative #1, Example 3, Example 4, showed good spinnability in the melt spinning process. Good draw down ratios were achieved and consistent multi and monofilament fibers were produced. However, fiber spinning could not be carried out on Comparative #2 and Comparative #3 as fiber spinning temperatures of greater than 240° C. were not attempted due to a potential of degradation. At temperatures of 180° C. to 220° C., high draw down ratios could not be achieved with Comparative #2 and Comparative #3 as fibers broke upon drawing.

Mechanical Property of Fibers:

Mechanical property testing on fibers was done using TA Internal method. approximately 96.52 cm long fiber samples were cut into 12 strands of approximately 8.05 cm in length. A small cross section was cut off of each fiber with a razor blade to measure the strand diameter on a microscope at 50× magnification in order to calculate the cross sectional area. The bundle of 12 fibers was then laid flat in a line and was taped on both ends with 2.54 cm wide duct tape. This produced a tensile specimen with a gauge length of approximately 3.81 cm between the tape ends. The taped ends were then loaded into grippers in an Instron tensile testing machine model 5565 with a 100N load cell. A stress strain curve was generated at 20 mm/min crosshead speed using the cross sectional area for the 12 yarn ends. The average of three specimens was recorded for tensile strength, modulus, and elongation at break.

TABLE 7

| | | Experiment Number | | | | |
|---|---|---|---|---|---|---|
| | | Comparative #1 | Spandex 2 | Example #5 | Example #6 | Example #7 |
| High Flow SBC 1 | | 100 | — | — | 100 | 100 |
| High Flow SBC 3 | | — | — | 100 | — | — |
| Softener | | — | — | 20 | — | — |
| Polyolefin (co)polymer 2 | | — | — | — | 13.33 | — |

TABLE 7-continued

| | | Experiment Number | | | | |
|---|---|---|---|---|---|---|
| | | Comparative #1 | Spandex 2 | Example #5 | Example #6 | Example #7 |
| Polyolefin (co)polymer 4 | | — | — | — | 20 | — |
| Polyolefin (co)polymer 3 | | — | — | — | — | 30 |
| Antioxidant | | — | — | 0.120 | 0.134 | 0.130 |
| Stabilizer 1 | | — | — | 0.120 | 0.134 | 0.130 |
| Stabilizer 2 | | — | — | 0.120 | 0.134 | 0.130 |
| Stabilizer 3 | | — | — | 0.120 | 0.134 | 0.130 |
| Detackifier | | — | — | 0.120 | 0.134 | 0.130 |
| Total (Wt.) | | 100 | — | 120.60 | 134.00 | 130.65 |
| Stress @ 100% Strain | MPa | 1.4 | 5.4 | 1.6 | 2.3 | 2.7 |
| Stress @ 300% Strain | MPa | 2.5 | 13.5 | 2.6 | 3.8 | 4.7 |
| Tensile Strength @ Break | MPa | 9.6 | 62.7 | 29.1 | 15.7 | 17.2 |
| Tensile Elongation | % | 1045 | 941 | 865 | 1049 | 1008 |

Each of Examples 5, 6 and 7 achieve better stress and tensile strength while maintaining high elongation at break results as compared to Comparative #1.

While in accordance with the patent statutes the best mode and preferred embodiment have been set forth, the scope of the invention is not limited thereto, but rather by the scope of the attached claims.

What is claimed is:

1. A fiber, comprising:

a multi-filament construction of monofilaments of identical composition that are at least partially bonded to each other, wherein each monofilament is monocomponent;

the fiber formed from a composition comprising i) a high flow styrenic block copolymer, the high flow styrenic block copolymer being a selectively hydrogenated styrene-diene-styrene or a selectively hydrogenated controlled distribution styrene-diene/styrene-styrene; ii) a polypropylene/alpha olefin copolymer; iii) a first detackifier that is a metal stearate and iv) at least one other ingredient comprising one or more of a) a polyolefin (co)polymer different than the polypropylene/alpha olefin copolymer, h) a polystyrene (co)polymer, and c) softener, wherein the high flow styrenic block copolymer is present in an amount greater than 50 parts by weight based on the total weight of polymer present in the composition;

wherein both of the following two conditions are present a) the high flow styrenic block copolymer has an ODT temperature of less than 280° C. and b) the composition has ODT temperature of less than 250° C.; and a detackifier coating comprising a second detackifier, different than the first detackifier and present directly on an outer surface of the multi-filament construction of monocomponent monofilaments, wherein the second detackifier comprises one or more of a fluoroadditive, a siloxane, and a silicone, and wherein the high flow styrenic block copolymer has a melt flow rate greater than 100 g/10 min at 230° C. under 2.16 kg mass according to ASTM D1238.

2. The fiber according to claim 1, wherein the high flow styrenic block copolymer has a number average molecular weight of 30,000 to 110,000 g/m.

3. The fiber according to claim 1, wherein the high flow styrenic block copolymer has an ODT temperature of less than 220° C.

4. The fiber according to claim 1, wherein the fiber includes two or more elastomeric materials in direct contact with one of the elastomeric materials comprising the high flow styrenic block copolymer.

5. The fiber according to claim 1, wherein the fiber has a lobe structure resulting with an irregular cross-sectional geometry.

6. The fiber according to claim 1, wherein the fiber is contacted with a second fiber comprising nylon or polyester.

7. The fiber according to claim 1, wherein the composition includes the softener in an amount from about 1 to about 100 parts by weight based on 100 parts by weight of the high flow styrenic block copolymer.

8. The fiber according to claim 1, wherein the high flow styrenic block copolymer has an ODT temperature of less than 250° C.

9. A fiber, comprising:

a multi-filament construction of monofilaments of identical composition that are at least partially bonded to each other, wherein each monofilament is monocomponent;

the fiber formed from a composition comprising i) a high flow styrenic block copolymer, the high flow styrenic block copolymer being a selectively hydrogenated styrene-diene-styrene or a selectively hydrogenated controlled distribution styrene-diene/styrene-styrene; ii) a polypropylene homopolymer; iii) a detackifier that is a metal stearate and iv) at least one other polymer comprising one or more of a) a polyolefin (co)polymer different than the polypropylene homopolymer, b) a polystyrene (co)polymer, and c) softener, wherein the high flow styrenic block copolymer is present in an amount greater than 50 parts by weight based on the total weight of polymer present in the composition;

wherein both of the following two conditions are present: a) the high flow styrenic block copolymer has an ODT temperature of less than 280° C. and b) the composition has ODT temperature of less than 250° C.; and wherein the fiber includes a slip coating layer directly on an outer surface of the the multi-filament construction of monocomponent monofilaments, wherein the slip coating layer is discontinuous and comprises one or more of cracks and fractures after a first stretching of the fiber beyond the elastic limit of the slip coating layer, and wherein the slip coating layer comprises a siloxane and one or more of a polyolefin and styrenic block copolymer, and wherein the high flow styrenic block copolymer has a melt flow rate greater than 100 g/10 min at 230° C. under 2.16 kg mass according to ASTM D1238.

10. The fiber according to claim 9, wherein the composition comprises the softener.

11. The fiber according to claim 10, wherein the high flow styrenic block copolymer has a number average molecular weight of 30,000 to 110,000 g/m, and wherein the high flow styrenic block copolymer has an ODT temperature of less than 220° C.

12. A fiber, comprising:

a multi-filament construction of monofilaments of identical composition that are at least partially bonded to each other, wherein each monofilament is monocomponent;

the fiber formed from a composition comprising i) a high flow styrenic block copolymer, the high flow styrenic block copolymer being a selectively hydrogenated styrene-diene-styrene or a selectively hydrogenated controlled distribution styrene-diene/styrene-styrene; ii) a polypropylene/alpha olefin copolymer; iii) a homopolypropylene polymer, and iv) a first detackifier that is a metal stearate;

wherein the high flow styrenic block copolymer is present in an amount greater than 50 parts by weight based on the total weight of polymer present in the composition; wherein the high flow styrenic block copolymer has a melt flow rate greater than 100 g/10 min at 280° C. under 2.16 kg mass according to ASTM D1238, wherein both of the following two conditions are present a) the high flow styrenic block copolymer has an ODT temperature of less than 280° C. and b) the composition has ODT temperature of less than 250° C.; and a detackifier coating comprising a second detacktifier, different than the first detackifier and present directly on an outer surface of the multi-filament construction of monocomponent monofilaments, wherein the second detackifier comprises one or more of a fluoroadditive, a siloxane, and a silicone.

* * * * *